US011319687B1

(12) United States Patent
Nozu et al.

(10) Patent No.: US 11,319,687 B1
(45) Date of Patent: May 3, 2022

(54) GROUND IMPROVEMENT APPARATUS

(71) Applicant: Fudo Tetra Corporation, Tokyo (JP)

(72) Inventors: Mitsuo Nozu, Tokyo (JP); Yuki Imai, Tokyo (JP); Yuji Yamashita, Tokyo (JP)

(73) Assignee: FUDO TETRA CORPORATION, Tokyo (JP)

( * ) Notice: Subject to any disclaimer, the term of this patent is extended or adjusted under 35 U.S.C. 154(b) by 0 days.

(21) Appl. No.: 17/501,279

(22) Filed: Oct. 14, 2021

(30) Foreign Application Priority Data

Mar. 12, 2021 (JP) ..... JP2021-040154

(51) Int. Cl.
*E02D 3/12* (2006.01)
*B26D 1/28* (2006.01)
*B26D 1/11* (2006.01)

(52) U.S. Cl.
CPC ..... *E02D 3/12* (2013.01); *B26D 1/11* (2013.01); *B26D 1/28* (2013.01); *E02D 3/126* (2013.01)

(58) Field of Classification Search
CPC .. B26D 1/11; B26D 1/28; E02D 3/126; E02D 3/12
See application file for complete search history.

(56) References Cited

U.S. PATENT DOCUMENTS 5,503,501 A * 4/1996 Kunito ..... E02D 5/36 405/269
5,645,376 A * 7/1997 Taki ..... E02D 5/36 405/269
6,685,398 B1 * 2/2004 Gunther ..... E02D 3/126 405/269
2008/0060851 A1 * 3/2008 Taniguchi ..... E02D 3/126 405/268

FOREIGN PATENT DOCUMENTS

| | | |
|---|---|---|
| JP | 7-197445 | 8/1995 |
| JP | 7-207656 | 8/1995 |
| JP | 2004-169304 | 6/2004 |
| JP | 2006-336427 | 12/2006 |
| JP | 2008-150872 | 7/2008 |

OTHER PUBLICATIONS

Decision to Grant a Patent (Office Action) issued in Japan Patent Appl. No. 2021-040154 dated May 18, 2021, along with an English translation thereof.

* cited by examiner

*Primary Examiner* — Carib A Oquendo
(74) *Attorney, Agent, or Firm* — Greenblum & Bernstein, P.L.C.

(57) ABSTRACT

A ground improvement apparatus includes: an inner shaft arranged inside an outer pipe and including a mechanism for rotating a crank at a rotation speed four times as fast as that of the outer pipe; agitation blades supported by the outer pipe so as to reciprocate in a radial direction of the outer pipe and including discharge outlets; and a slider crank mechanism for converting a rotation movement of the crank to a reciprocating movement of the agitation blades. A ground at a location where the outer pipe is penetrated and a solidifying material discharged from the discharge outlets are agitated and mixed with each other to form an improved body having a substantially rectangular cross section by rotating the agitation blades while advancing and retreating the agitation blades relative to each other via the slider crank mechanism by rotation of the crank.

3 Claims, 7 Drawing Sheets

GROUND IMPROVEMENT APPARATUS

CROSS REFERENCE TO RELATED APPLICATION

This application is based upon and claims the benefit of priority from the prior Japanese Patent Application No. 2021-040154, filed on Mar. 12, 2021, the entire contents of which are incorporated herein by reference.

BACKGROUND

1. Technical Field

The disclosure relates to a ground improvement apparatus which forms an improved body having a rectangular cross section by reciprocating agitation blades while rotating the agitation blades.

2. Related Art

The ground agitator described in Japanese Unexamined Patent Publication No. 2006-336427 is a ground improvement apparatus which forms an improved body having a rectangular cross section by applying the principle of a Reuleaux triangle, there is. The ground agitator includes a drive mechanism, a discharge mechanism, excavation cutters, and agitation blades. The driving mechanism includes a Reuleaux rotary shaft, a shaft receiver, and a driving unit. The Reuleaux rotary shaft has a cross-section of a Reuleaux triangle shape. The shaft receiver rotatably supports a Reuleaux triangle shaped-portion in a square shape having sides that are the same length as an outer width of the Reuleaux triangle shaped-portion. The driving unit rotationally drives the Reuleaux rotary shaft. The driving mechanism is provided to be movable in an axial direction of the Reuleaux rotary shaft. The discharge mechanism discharges a sediment solidifying material from a distal end of the Reuleaux rotary shaft extended to a distal surface of the shaft receiver. The excavation cutters are provided at the distal end of the Reuleaux rotary shaft and are formed within a range of the Reuleaux triangle shape in which the center of gravity and directions of vertices are matched to the Reuleaux triangle shape of the Reuleaux rotary shaft by enlarging the Reuleaux triangle shape of the Reuleaux rotary shaft. The agitation blades are provided between the shaft receiver of the Reuleaux rotary shaft and the excavation cutters and are formed in the same manner as the excavation cutters.

In the ground agitator described above, the solidifying material is discharged from the distal end of the Reuleaux rotary shaft while excavating a substantially rectangular hole by rotation of the Reuleaux rotary shaft, and soil of the ground and the solidifying material are agitated and mixed by the agitation blades to form an underground continuous wall (improved body) having a rectangular cross section.

SUMMARY

In the ground agitator described above, the entire apparatus is large in scale. Further, in the ground agitator described above, the diameters of the Reuleaux rotary shaft and a shaft receiving portion around the Reuleaux rotary shaft become large and thus the Reuleaux rotary shaft and the shaft receiving portion become a large obstacle (load) when they are penetrated into the ground, which makes it difficult to smoothly construct the improved body.

The disclosure is directed to a ground improvement apparatus which is compact and can easily and reliably form an improved body having a rectangular cross section.

A ground improvement apparatus in accordance with some embodiments includes: an outer pipe rotated by a driver; an inner shaft arranged inside the outer pipe and including a mechanism configured to rotate a crank at a rotation speed four times as fast as a rotation speed of the outer pipe; a pair of agitation blades supported by the outer pipe so as to reciprocate in a radial direction of the outer pipe and including discharge outlets for discharging a solidifying material; and a slider crank mechanism configured to convert a rotation movement of the crank to a reciprocating movement of the pair of agitation blades. A ground at a location where the outer pipe is penetrated and the solidifying material discharged from the discharge outlets of the pair of agitation blades are agitated and mixed with each other to form an improved body having a substantially rectangular cross section by rotating the pair of agitation blades while advancing and retreating the pair of agitation blades relative to each other via the slider crank mechanism by rotation of the crank.

According to the aforementioned configurations, the pair of agitation blades are rotated while being advanced and retreated relative to each other via the slider crank mechanism by rotation of the crank. Thus, an improved body having a rectangular cross section can be easily and reliably formed by a compact apparatus. As a result, when a continuous improved body is constructed by connecting improved bodies, lap portions which are overlapping portions of the improved bodies are not required and thus the cost for solidifying material can be reduced.

DETAILED DESCRIPTION

Figure 1:
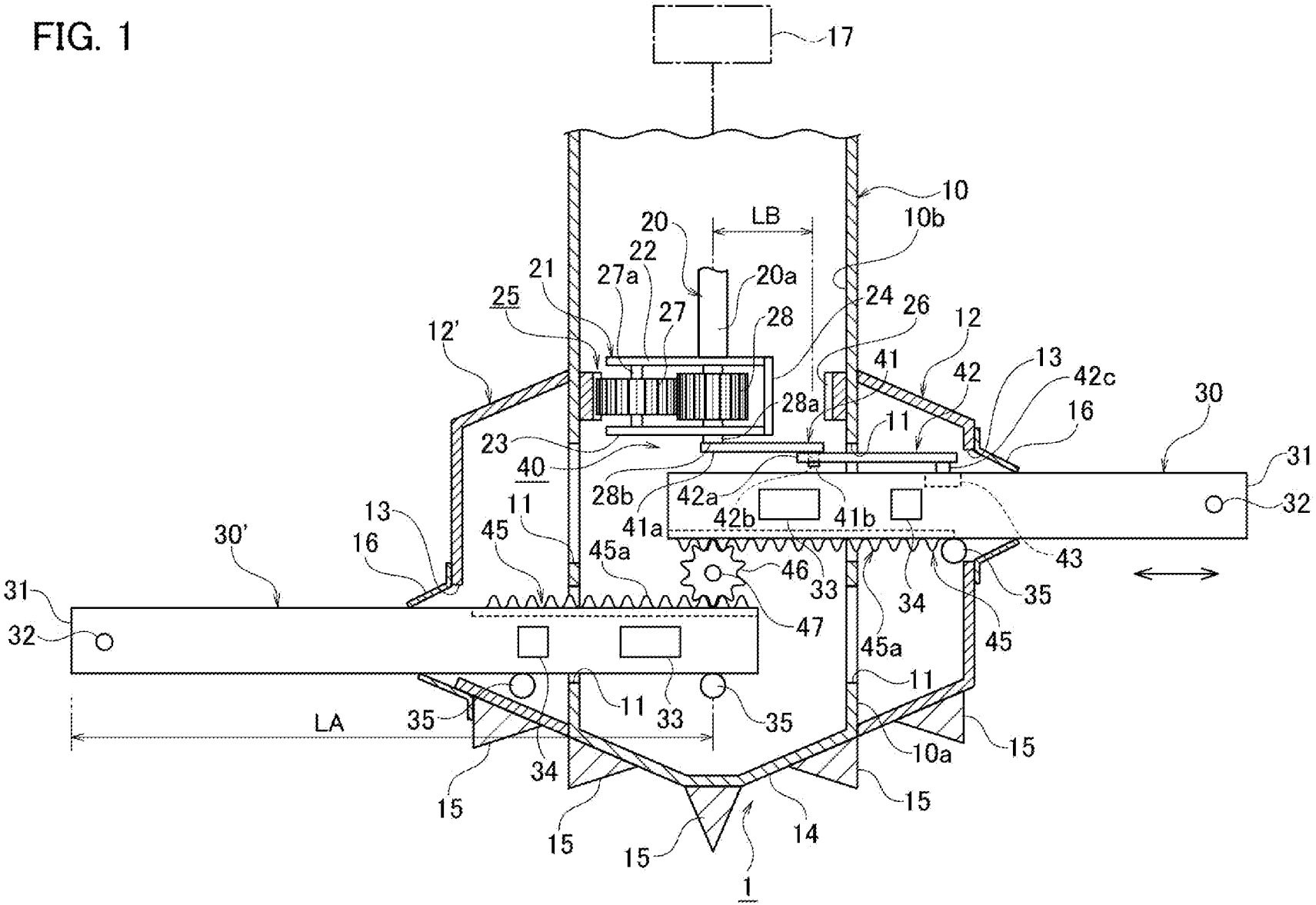
FIG. 1 is a schematic sectional view of a ground improvement apparatus according to a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from that in reality.

Figure 2:
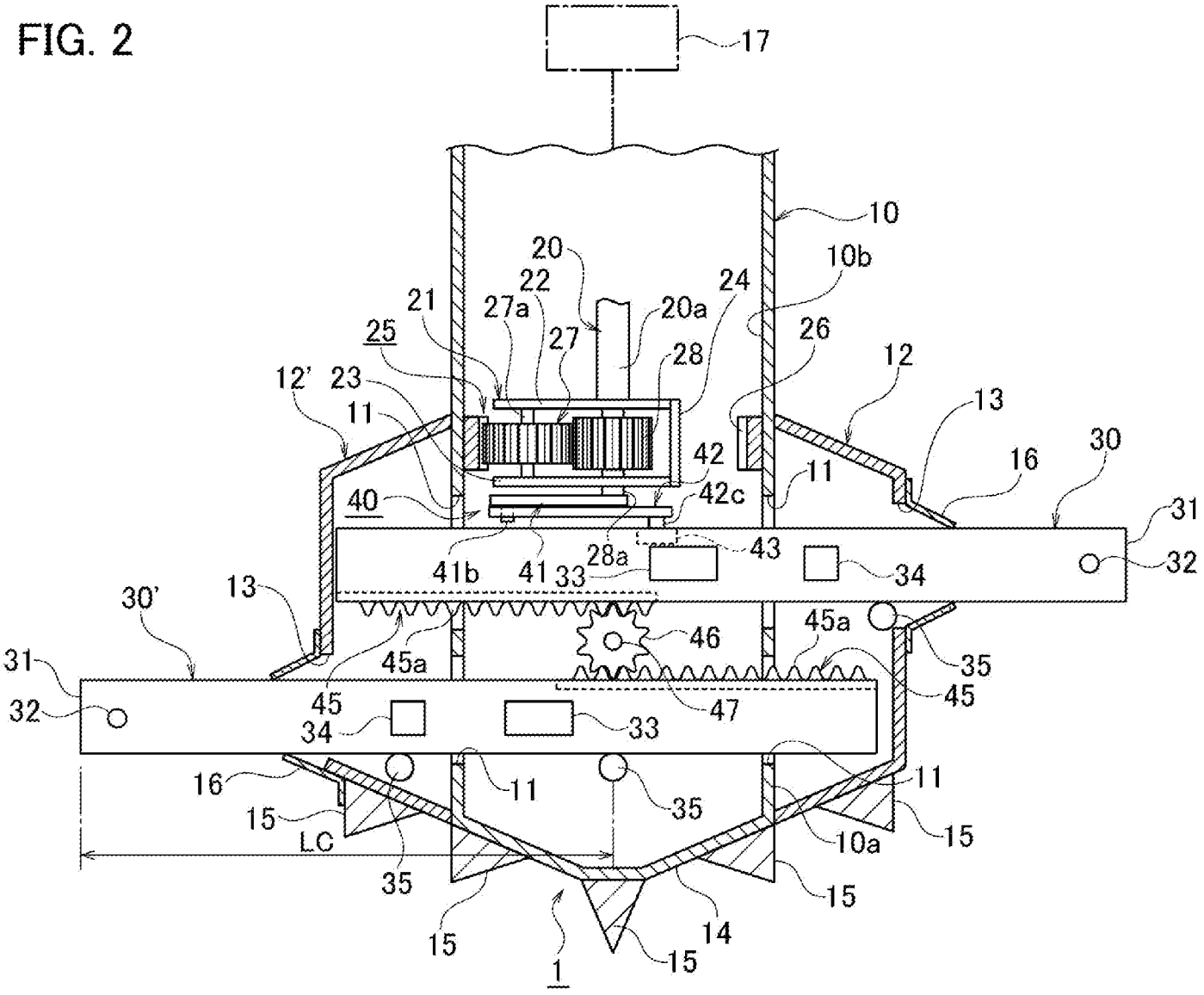
FIG. 2 is a schematic sectional view illustrating a state where a pair of agitation blades supported by an outer pipe of the ground improvement apparatus of FIG. 1 are retreated.
Figure 3:
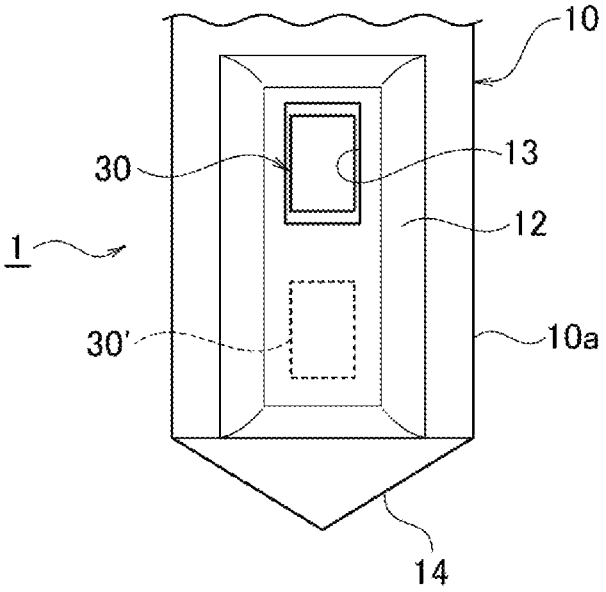
FIG. 3 is a schematic side view illustrating a state where an overhanging portion of the outer pipe and the agitation blades of FIG. 2 are supported.
Figure 4:
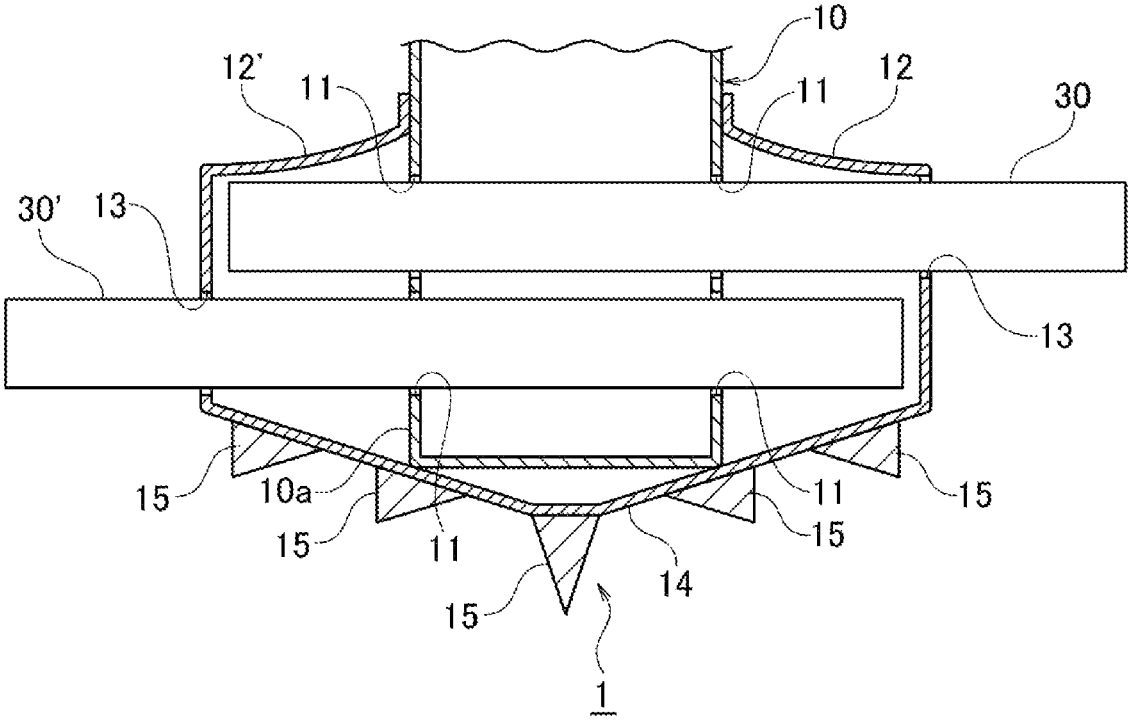
FIG. 4 is a schematic front view illustrating the state where the overhanging portion of the outer pipe and the agitation blades of FIG. 2 are supported.
Figure 5:
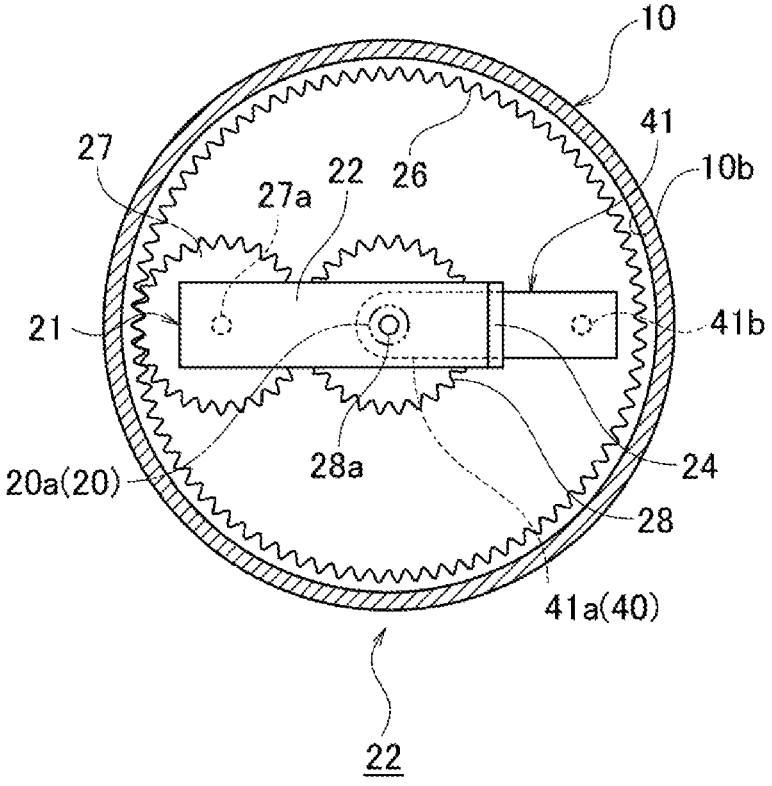
FIG. 5 is a schematic sectional view of a crank rotation mechanism of the ground improvement apparatus of FIG. 1.
Figure 6A:
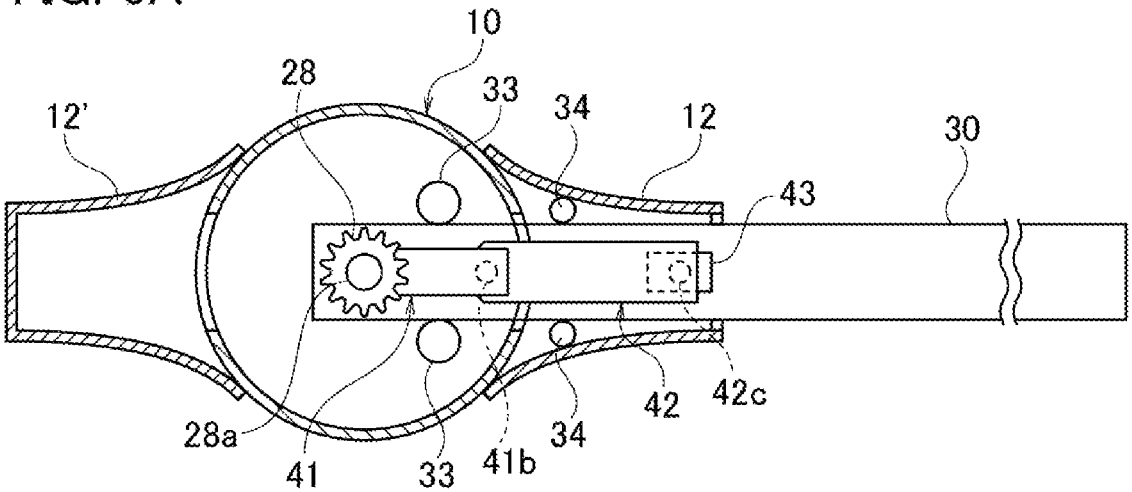
FIG. 6A is a schematic plan view illustrating a state where one of the agitation blades is advanced before a crank of the ground improvement apparatus of FIG. 1 rotates.
Figure 6B:
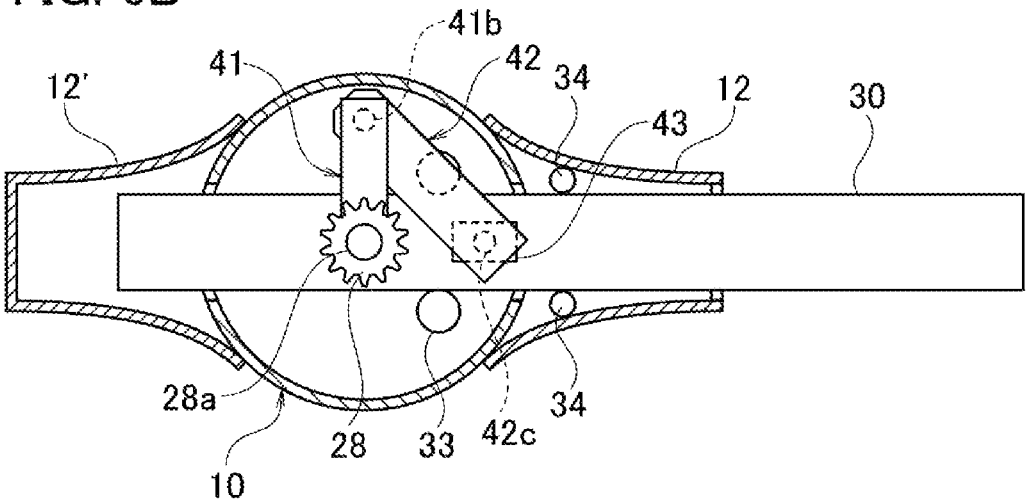
FIG. 6B is a schematic plan view illustrating a state where the crank of FIG. 6A is rotated by 90 degrees and the one of the agitation blades is being retreated.
Figure 6C:
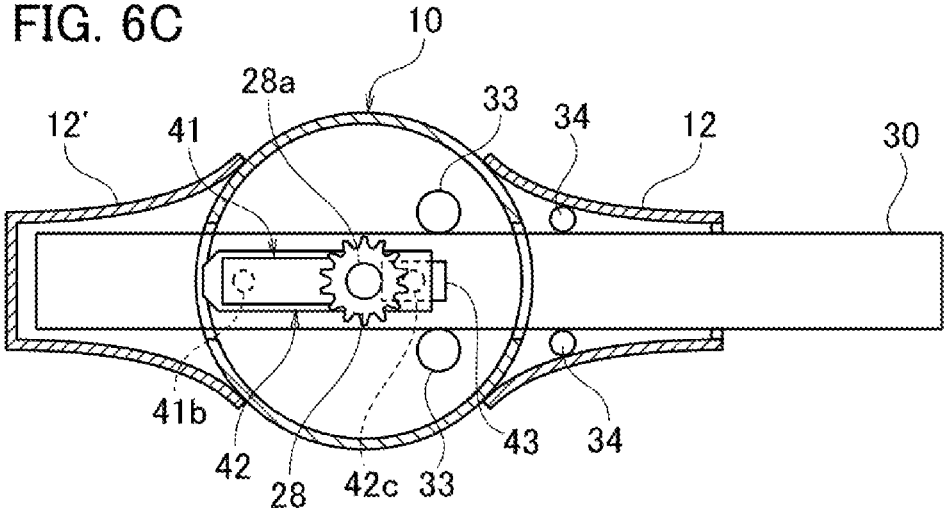
FIG. 6C is a schematic plan view illustrating a state where the crank of FIG. 6A is rotated by 180 degrees and the one of the agitation blades is retreated.
Figure 7:
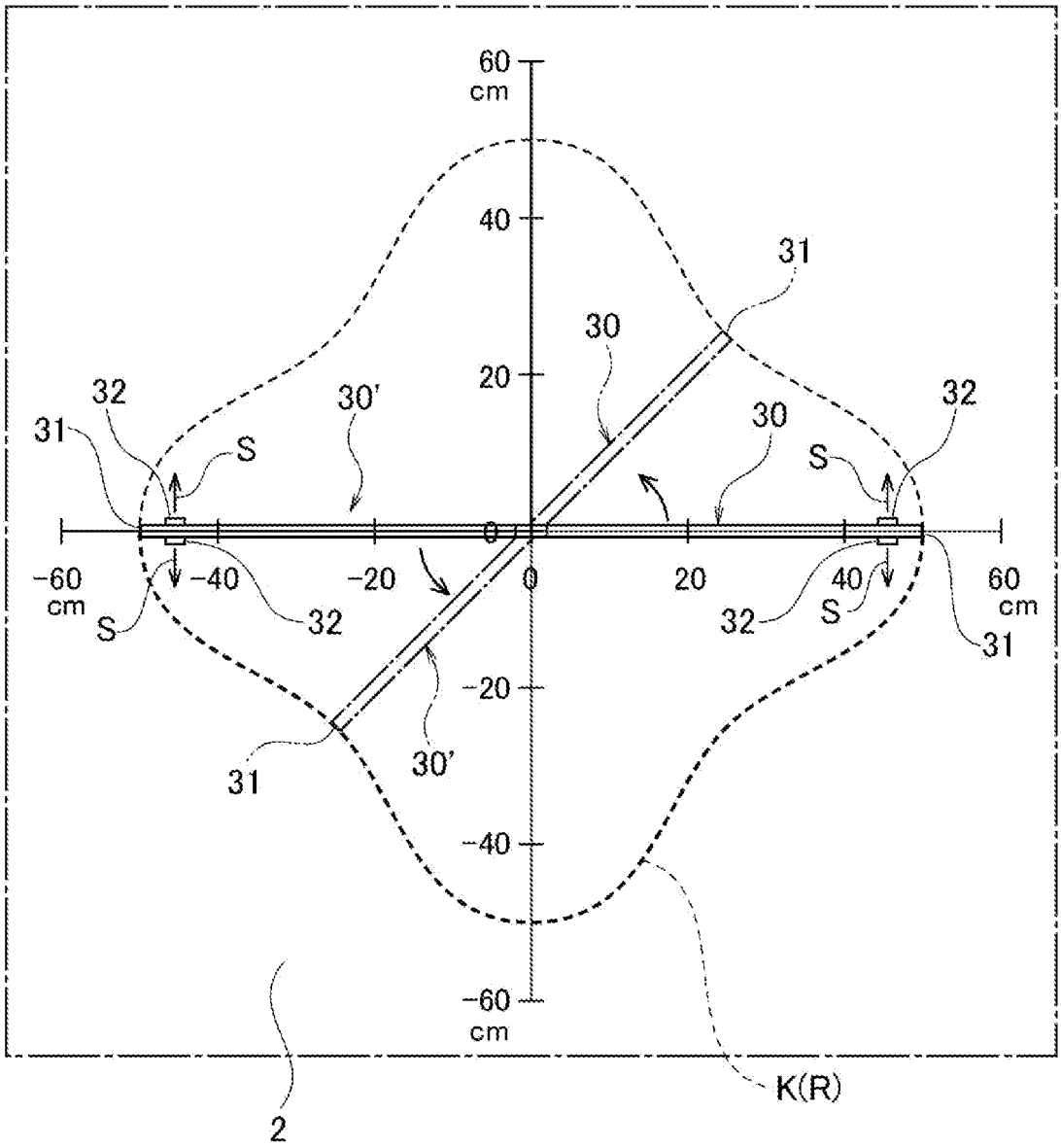
FIG. 7 is an explanatory diagram of a substantially regular quadrangular trajectory drawn by distal ends of the pair of agitation blades by rotation of the outer pipe of FIG. 2.

FIG. 1 is a schematic sectional view of a ground improvement apparatus 1 according to a first embodiment of the disclosure. FIG. 2 is a schematic sectional view illustrating a state where a pair of agitation blades 30, 30' supported by an outer pipe 10 of the ground improvement apparatus 1 are retreated. FIG. 3 is a schematic side view illustrating a state where an overhanging portion of the outer pipe 10 and the agitation blades 30, 30' are supported. FIG. 4 is a schematic front view illustrating the state where the overhanging portion of the outer pipe 10 and the agitation blades 30, 30' are supported. FIG. 5 is a schematic sectional view of a crank rotation mechanism 25 of the ground improvement apparatus 1. FIG. 6A is a schematic plan view illustrating a state where one agitation blade 30 of the agitation blades 30, 30' is advanced before a crank 41 of the ground improvement apparatus 1 rotates. FIG. 6B is a schematic plan view illustrating a state where the crank 41 is rotated by 90 degrees and the one agitation blade 30 of the agitation blades 30, 30' is being retreated. FIG. 6C is a schematic plan view illustrating a state where the crank 41 is rotated by 180 degrees and the one agitation blade 30 of the agitation blades 30, 30' is retreated. FIG. 7 is an explanatory diagram of a substantially regular quadrangular trajectory K drawn by distal ends 31 of the pair of agitation blades 30, 30' by rotation of the outer pipe 10.

As illustrated in FIGS. 1 and 2, the ground improvement apparatus 1 includes an outer pipe 10, an inner shaft 20, a pair of agitation blades 30, 30', and a slider crank mechanism 40. The outer pipe 10 is rotated by an auger motor 17. The inner shaft 20 is arranged to extend inside the outer pipe 10 and includes a mechanism which rotates a crank 41 at a rotation speed four times as fast as a rotation speed of the outer pipe 10. The pair of agitation blades 30, 30' are supported by the outer pipe 10 so as to reciprocate in a radial direction of the outer pipe 10 and include discharge outlets 32 for discharging a slurry-like solidifying material S. The slider crank mechanism 40 converts a rotation movement of the crank 41 to a reciprocating movement of the pair of agitation blades 30, 30'. When the outer pipe 10 is penetrated into a ground 2, the ground improvement apparatus 1 discharges the slurry-like solidifying material S from the discharge outlets 32 of the pair of agitation blades 30, 30' and agitates and mixes, by means of the pair of agitation blades 30, 30', the ground 2 at a location where the outer pipe 10 has been penetrated and the slurry-like solidifying material S with each other, thereby forming an improved body R having a substantially regular quadrangular (rectangular) cross section and improving the ground 2.

The outer pipe 10 lifts and lowers (moves up and down) via a lifting and lowering driving device (not shown) along a leader (not shown) erected in front of a construction machine body, and the outer pipe 10 is rotated by the auger motor (driver) 17. As illustrated in FIGS. 1 to 4, the outer pipe 10 has a cylindrical shape made of metal. The outer pipe 10 includes pairs of upper and lower rectangular openings 11 at right and left positions facing each other at a distal end 10*a* side of the outer pipe 10. The pairs of upper and lower rectangular openings 11 on both sides of the outer pipe 10 are covered with box-shaped crank housings 12, 12' as overhanging portions which are larger in diameter than the outer pipe 10 and house the slider crank mechanism 40 therein. At an upper side of one crank housing 12, a rectangular window 13 through which one agitation blade 30 advances and retreats (moves forward and backward) is provided. At a lower side of the other crank housing 12', a rectangular window 13 through which the other agitation blade 30' advances and retreats (moves forward and backward) is provided. Each of the windows 13 is covered with a protective cover 16 made of rubber, resin, or the like for preventing mud from entering so that the excavated soil of the ground 2 does not enter into the outer pipe 10 and the crank housings 12, 12'.

As illustrated in FIGS. 1, 2, and 4, an opening at the distal end 10*a* of the outer pipe 10 is covered with a blocking plate 14 having a substantially pyramidal surface with ridges extending from a bottom of the one crank housing 12 to a bottom of the other crank housing 12'. A plurality of excavation bits 15 are provided to protrude from an outer surface of the blocking plate 14.

As illustrated in FIGS. 1 and 2, the inner shaft 20 is arranged inside the outer pipe 10 to extend non-rotatably. A shaft receiving box 21 is fixed to a distal end 20*a* of the inner shaft 20. The shaft receiving box 21 is formed in a U-shape in cross section by fixing ends of a non-rotatable upper shaft receiver 22 fixed to the distal end 20*a* of the inner shaft 20 and a lower shaft receiver 23 to a connection member 24. The shaft receiving box 21 includes therein a crank rotation mechanism 25 described later which rotates the crank 41 of the slider crank mechanism 40.

As illustrated in FIGS. 1, 2, and 5, the crank rotation mechanism 25 includes an inner peripheral gear 26 having an annular cylindrical shape and a drive gear 28. The inner peripheral gear 26 is fixed along an inner periphery 10*b* of the outer pipe 10 and rotates together with the outer pipe 10. The drive gear 28 meshes with the inner peripheral gear 26 via an intermediate gear 27 to rotate the crank 41.

As illustrated in FIG. 1, the intermediate gear 27 is fixed to the center of a shaft 27*a* rotatably supported by the upper shaft receiver 22 and the lower shaft receiver 23. The drive gear 28 is fixed to a shaft 28*a* at a location above the center thereof, the shaft 28*a* being rotatably supported by the upper shaft receiver 22 and the lower shaft receiver 23. That is, the intermediate gear 27 and the drive gear 28 are rotatably supported by the upper shaft receiver 22 and the lower shaft receiver 23 via the shafts 27*a* and 28*a* respectively.

As illustrated in FIG. 1, the shaft 28*a* of the drive gear 28 extends downward through the lower shaft receiver 23. A base end 41*a* of the crank 41 is fixed to a distal end 28*b* of the shaft 28*a*. Due to this fixation, a rotational force of the drive gear 28 is transmitted to the base end 41*a* of the crank 41 and a crank operation shaft 41*b* which protrudes downward from a distal end side of the crank 41 is rotated. That is, a rotational force of the crank 41 is obtained from a rotational force of the outer pipe 10 via the crank rotation mechanism 25.

The tooth ratio between the inner peripheral gear 26 of the outer pipe 10, the intermediate gear 27, and the crank 41 of the crank rotation mechanism 25 is set to, for example, 8:3:2, so that the crank 41 rotates at a rotation speed four times as fast as a rotation speed of the outer pipe 10. The rotational force of the crank 41 is converted into a reciprocating movement of the pair of agitation blades 30, 30' by a shaft receiver (slide converter) 43 via a crankshaft 42 of the slider crank mechanism 40 described later.

As illustrated in FIGS. 1 and 2, the pair of agitation blades 30, 30' are supported reciprocatably by the respective windows 13 in the pair of right and left crank housings 12, 12' of the outer pipe 10 so as to reciprocate in the radial direction of the outer pipe 10, and rotate in accordance with rotation of the outer pipe 10. The discharge outlets 32 formed of nozzles or the like for discharging the slurry-like solidifying material S are provided at front and back sides of distal ends 31 of the pair of agitation blades 30, 30'. Front and back sides of each of the pair of agitation blades 30, 30' are sandwiched and supported so as to reciprocate by two large support rollers 33 for preventing lateral displacement rotatably supported in the outer pipe 10 and two small support rollers 34 for preventing lateral displacement rotatably supported in the pair of left and right crank housings 12, 12'. Lower sides of each of the pair of agitation blades 30, 30' are supported so as to reciprocate by one or two support rollers 35 rotatably supported in the outer pipe 10 and in the pair of left and right crank housings 12, 12'. Through these support rollers 33, 34, and 35, as illustrated in FIGS. 6A to 6C, the pair of agitation blades 30, 30' can smoothly reciprocate in the radial direction of the outer pipe 10.

As illustrated in FIGS. 1 and 2, the slider crank mechanism 40 includes the crank 41, the crank rotation mechanism 25, the crankshaft 42, the shaft receiver (slide converter) 43, a pair of rack rails 45, and a pinion 46. The base end 41*a* of the crank 41 is fixed to the distal end 28*b* of the shaft 28*a* of the drive gear 28. The crank rotation mechanism 25 rotates the crank 41. The crankshaft 42 rotates with a base end 42*a* of the crankshaft 42 pivotally supported by the crank operation shaft 41*b* at the distal end side of the crank 41. The shaft receiver 43 is embedded in the upper surface side of the one agitation blade 30 of the agitation blades 30, 30' and rotatably supports a shaft 42*c* having a cylindrical shape and protruding downward from a distal end side of the crankshaft 42. The pair of rack rails 45 are provided on the pair of agitation blades 30, 30' respectively in the vicinity of the inner shaft 20 at positions facing each other. The pinion 46 meshes with racks 45*a* of the pair of rack rails 45.

As illustrated in FIGS. 1 and 2, the cylindrical crank operation shaft 41*b* at the distal end side of the crank 41 is inserted into a circular hole 42*b* formed in the distal end 42*a* of the crankshaft 42, thereby the crankshaft 42 is rotatably and pivotally supported by the shaft 41*b* of the crank 41. The pinion 46 is rotatably supported by the outer pipe 10 via a support shaft 47. When the one agitation blade 30 is pulled and moved radially outward (advanced) from the openings 11 in the outer pipe 10 by the shaft receiver 43 moving via the shaft 42*c* by rotation of the crankshaft 42, the pinion 46 is rotated via the rack rails 45 and the other agitation blade 30' is also moved radially outward (advanced) from the openings 11 in the outer pipe 10.

In this way, since the crank operation shaft 41*b* of the crank 41 pivotally supports the base end 42*a* of the crankshaft 42, the rotation movement of the crank 41 is converted into the reciprocating movement of the one agitation blade 30 (the other agitation blade 30' is the same) in the radial direction of the outer pipe 10 via the shaft receiver 43 supporting the shaft 42*c* of the crankshaft 42. In this case, the pair of agitation blades 30, 30' reciprocate four times during one rotation (360 degree rotation) of the outer pipe 10. Specifically, the rotation of the inner shaft 20 causes the pair of agitation blades 30, 30' to sequentially repeat an advancing movement and a retreating movement at intervals of a 45 degree rotation of the outer pipe 10 during one rotation of the outer pipe 10, so that as illustrated in FIG. 7, a substantially regular quadrangular shape is formed by the trajectory K of the distal ends 31 of the pair of agitation blades 30, 30'. Thus, the ground 2 at the location where the outer pipe 10 has been penetrated and the slurry-like solidifying material S discharged from the discharge outlets 32 of the pair of agitation blades 30, 30' are agitated and mixed to form the improved body R having the substantially regular quadrangular (rectangular) cross section.

As illustrated in FIG. 1, the length LA from the center line of the inner shaft 20 to each of the distal ends 31 of the pair of agitation blades 30, 30' when the pair of agitation blades 30, 30' are advanced is set to, for example, a dimension of 500 mm (LA=500 mm). In this case, the length LB from the center line of the inner shaft 20 to the crank operation shaft 41*b* of the crank 41 is set to, for example, a dimension of 73 mm (LB=73 mm). As illustrated in FIG. 2, the length LC from the center line of the inner shaft 20 to each of the distal ends 31 of the pair of agitation blades 30, 30' when the pair of agitation blades 30, 30' are retreated is set to, for example, a dimension of 354 mm (LC=354 mm).

According to the ground improvement apparatus 1 in accordance with the first embodiment, when the outer pipe 10 is penetrated into the ground 2 while being rotated, the pair of agitation blades 30, 30' are rotated while being advanced and retreated relative to each other via the slider crank mechanism 40 by the rotation of the crank 41. As a result, the ground 2 at the location where the outer pipe 10 has been penetrated and the slurry-like solidifying material S discharged from the respective discharge outlets 32 of the pair of agitation blades 30 and 30' are agitated and mixed to form the improved body R having the substantially regular quadrangular cross section.

As described above, by rotating the pair of agitation blades 30, 30' while advancing and retreating the pair of agitation blades 30, 30' relative to each other, the improved body R having the substantially regular quadrangular cross section can be smoothly, easily, and reliably formed by a compact apparatus. Hence, when a continuous improved body is constructed by connecting the improved bodies R, lap portions which are overlapping portions of the improved bodies R are not required and thus the cost for the solidifying material S can be reduced.

Figure 8:
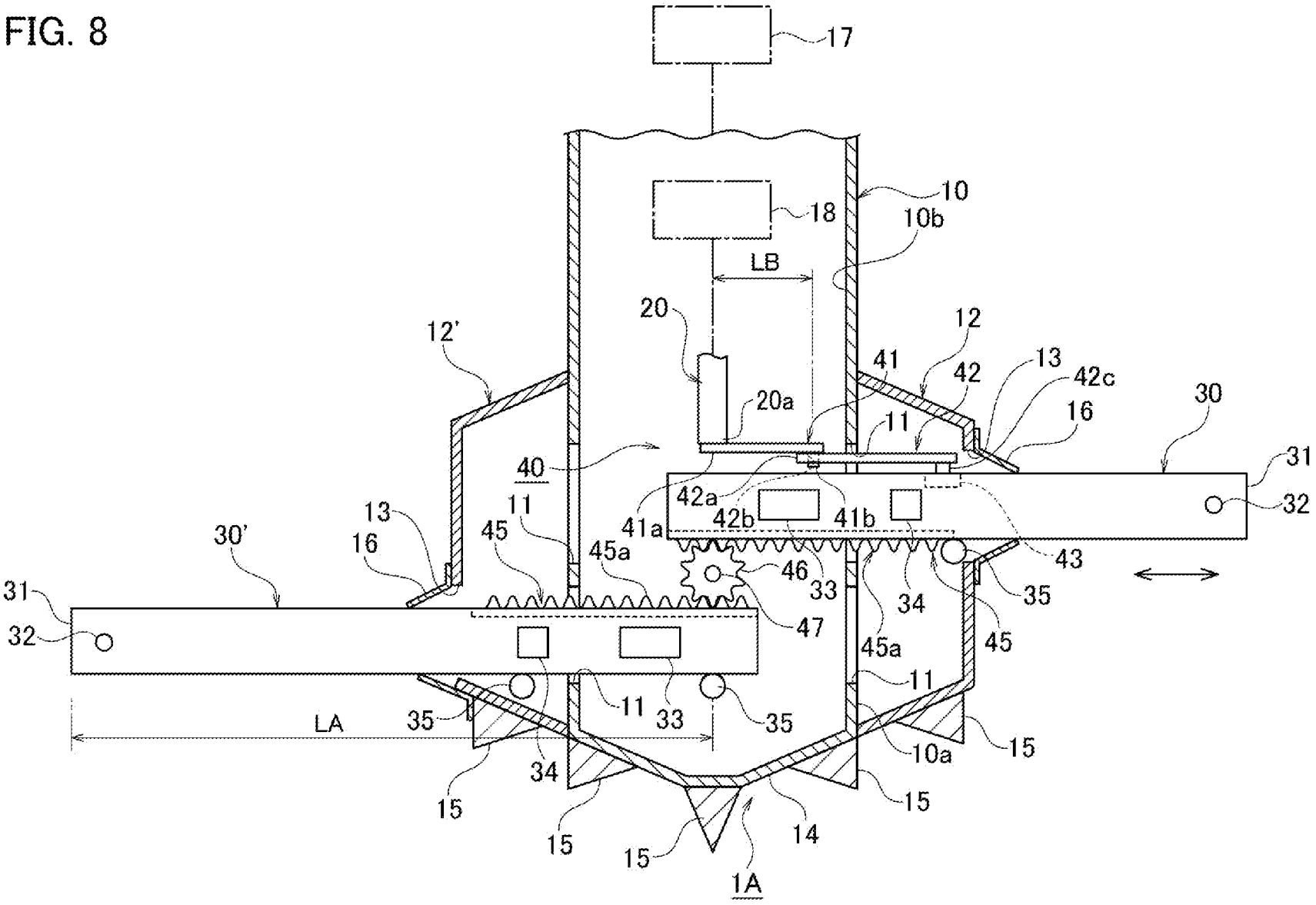
FIG. 8 is a schematic sectional view of a ground improvement apparatus according to a second embodiment.

FIG. 8 is a schematic sectional view of a ground improvement apparatus 1A according to a second embodiment of the disclosure.

The ground improvement apparatus 1A according to the second embodiment is different from the ground improvement apparatus 1 according to the first embodiment in that the inner shaft 20 is directly connected to the auger motor (driver) 18 and the base end 41*a* of the crank 41 is fixed to the distal end 20*a* of the inner shaft 20. Since the other elements are the same as those of the first embodiment, the same elements are denoted by the same reference numerals and detailed descriptions thereof are omitted.

In the ground improvement apparatus 1A according to the second embodiment, the crank 41 is directly rotated by rotation of the inner shaft 20. Thus, the same operation and effect as in the first embodiment can be achieved with a simpler structure.

Embodiments of the present invention have been described above. However, the invention may be embodied in other specific forms without departing from the spirit or essential characteristics thereof. The present embodiments are therefore to be considered in all respects as illustrative and not restrictive. The scope of the invention is indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A ground improvement apparatus, comprising:

an outer pipe rotated by a driver;

an inner shaft extended and arranged inside the outer pipe and including a mechanism configured to rotate a crank at a rotation speed four times as fast as a rotation speed of the outer pipe;

a pair of agitation blades supported by the outer pipe so as to reciprocate in a radial direction of the outer pipe and including discharge outlets for discharging a solidifying material; and a slider crank mechanism configured to convert a rotation movement of the crank to a reciprocating movement of the pair of agitation blades, wherein a ground at a location where the outer pipe is penetrated and the solidifying material discharged from the discharge outlets of the pair of agitation blades are agitated and mixed with each other to form an improved body having a substantially rectangular cross section by rotating the pair of agitation blades while advancing and retreating the pair of agitation blades relative to each other via the slider crank mechanism by rotation of the crank.

2. The ground improvement apparatus according to claim 1, wherein the slider crank mechanism comprises:

a crank rotation mechanism configured to rotate the crank;

a crankshaft configured to rotate with a base end of the crankshaft pivotally supported by the crank;

a slide converter provided in one of the pair of agitation blades and configured to rotatably support a shaft protruding from the crankshaft;

a pair of rack rails provided on the pair of agitation blades at positions of the pair of agitation blades facing each other; and a pinion configured to mesh with racks of the pair of rack rails, and the improved body having the substantially rectangular cross section is formed by sequential repetition of an advancing movement and a retreating movement of the pair of agitation blades at intervals of a 45 degree rotation of the outer pipe during a 360 degree rotation of the outer pipe.

3. The ground improvement apparatus according to claim 2, wherein the crank rotation mechanism comprises:

an inner peripheral gear having an annular cylindrical shape, the inner peripheral gear fixed to the outer pipe along an inner periphery of the outer pipe and configured to rotate together with the outer pipe; and a drive gear configured to mesh with the inner peripheral gear via an intermediate gear and rotate the crank, and the crankshaft is rotated at a rotation speed four times as fast as the rotation speed of the outer pipe with the base end of the crankshaft pivotally supported by a crank operation shaft protruding from a distal end of the crank.

* * * * *